United States Patent [19]

Tabata et al.

[11] Patent Number: 4,785,296

[45] Date of Patent: Nov. 15, 1988

[54] METHOD AND SYSTEM FOR DISPLAYING IMAGE DATA

[75] Inventors: Kuniaki Tabata, Tokyo; Tetsuo Machida; Susumu Tsuhara, both of Sagamihara; Hidefumi Iwami, Yokohama; Yasuyuki Okada, Sagamihara, all of Japan

[73] Assignee: Hitachi, Ltd., Tokyo, Japan

[21] Appl. No.: 14,078

[22] Filed: Feb. 3, 1987

Related U.S. Application Data

[63] Continuation of Ser. No. 509,395, Jun. 30, 1983, abandoned.

[30] Foreign Application Priority Data

Jul. 2, 1982 [JP] Japan ..... 57-113886
Jul. 7, 1982 [JP] Japan ..... 57-116773

[51] Int. Cl.[4] ..... G09G 1/16

[52] U.S. Cl. ..... 340/731; 340/721; 340/723; 340/735

[58] Field of Search ..... 340/721, 723, 731, 735, 340/748, 750, 798, 789

[56] References Cited

U.S. PATENT DOCUMENTS

| | | | |
|---|---|---|---|
| 4,168,489 | 9/1979 | Ervin | 340/731 |
| 4,373,194 | 2/1983 | Demke et al. | 340/731 |
| 4,418,345 | 11/1983 | Demke et al. | 340/731 |
| 4,428,065 | 1/1984 | Duvall et al. | 340/731 |
| 4,455,554 | 6/1984 | Demke | 340/731 |
| 4,479,119 | 10/1984 | Sakano | 340/731 |
| 4,503,427 | 3/1985 | Iida | 340/731 |
| 4,532,602 | 7/1985 | Duvall | 340/731 |
| 4,546,349 | 10/1985 | Prohofsky et al. | 340/731 |
| 4,586,156 | 4/1986 | Kurata et al. | 340/731 |
| 4,649,380 | 3/1987 | Penna | 340/731 |

OTHER PUBLICATIONS

Abbreviated Character Font Display, Bringol, IBM Tech. Disc. Bul., vol. 19, No. 9, 2/77, pp. 3248-3249.

Combination of Alphanumeric and Formatting Data on CRT Display, Webb, IBM Tech. Disc. Bul., vol. 15, No. 7, 12/72, p. 2146.

*Primary Examiner*—Gerald L. Brigance

*Attorney, Agent, or Firm*—Antonelli, Terry & Wands

[57] ABSTRACT

A display system which uses one display unit as if it were a plurality of display units to separately display whole information and partial information of document is disclosed. A plurality of display windows are defined on one display screen and a layout or a reduced image of the whole information is displayed in one of the window and information or image representing the information of a partial area of the whole information is displayed in other window. When one of the whole information and the partial area information is changed, the other information is also changed correspondingly, or a mark indicating a relation between the whole information and the partial area information is displayed in one of the window.

9 Claims, 14 Drawing Sheets

| TYPE OF WINDOW | WINDOW POSITION | | WINDOW SIZE | | QUARRY POSITION | |
|---|---|---|---|---|---|---|
| | HOR. | VER. | HOR. | VER. | HOR. | VER. |
| WHOLE-VIEW | $X_A$ | $Y_A$ | $W_A$ | $H_A$ | | |
| PARTIAL-VIEW | $X_B$ | $Y_B$ | $W_B$ | $H_B$ | $S_B$ | $T_B$ |

FIG. 4
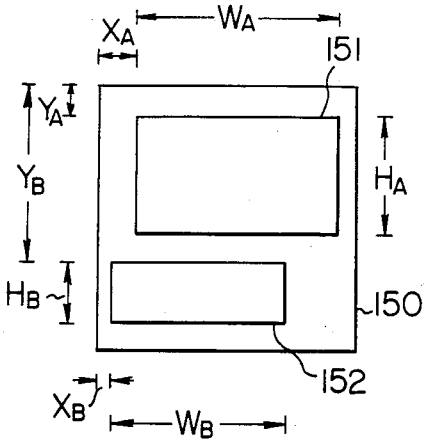
FIG. 5
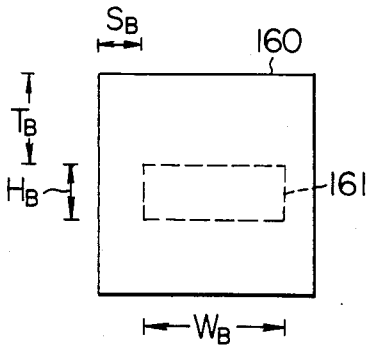
FIG. 6
| TITLE OF DOCUMENT | LOCATION ON DOCUMENT FILE | |
|---|---|---|
| | STORE ADDRESS | DATA LENGTH |
| | | |
| | | |
| | | |
| | | |

| COMMAND | FUNCTION |
|---|---|
| FIND | READ OUT SPECIFIED DOCUMENT INFORMATION FROM FILE DEVICE AND DISPLAY IT |
| SCROLL | MOVE QUARRY POSITION ON WHOLE IMAGE OF DOCUMENT AND CHANGE CONTENT OF PARTIAL-VIEW WINDOW |
| SCOPE | CHANGE WINDOW POSITION ON SCREEN AND WINDOW SIZE |
| INSERT | INSERT CHARACTER DATA INTO DOCUMENT |
| DELETE | DELETE CHARACTER DATA FROM DOCUMENT |

FIG. 15
| TYPE OF WINDOW | WINDOW POSITION | | WINDOW SIZE | | QUARRY POSITION | |
|---|---|---|---|---|---|---|
| | HOR. | VER. | HOR. | VER. | HOR. | VER. |
| IMAGE WINDOW | $X_I$ | $Y_I$ | $W_I$ | $H_I$ | | |
| TEXT WINDOW | $X_T$ | $Y_T$ | $W_T$ | $H_T$ | S | T |
FIG. 16
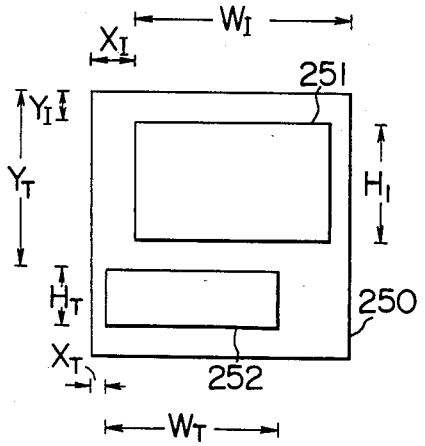
FIG. 17
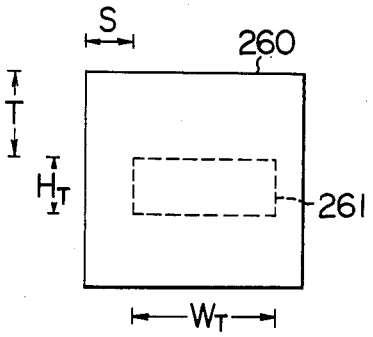

FIG. 18

| TITLE OF DOCUMENT | LOCATION ON DOCUMENT FILE | |
|---|---|---|
| | STORE ADDRESS | DATA LENGTH |
| | | |
| | | |
| | | |
| | | |

FIG. 19

| COMMAND | FUNCTION |
|---|---|
| FIND | READ OUT DESIGNATED DOCUMENT INFORMATION FROM DOCUMENT FILE AND DISPLAY IT |
| SCROLL | MOVE QUARRY POSITION ON DOCUMENT INFORMATION DISPLAYED ON TEXT WINDOW |
| INSERT | INSERT CHARACTER IN DOCUMENT |
| DELETE | DELETE CHARACTER FROM DOCUMENT |

| SCROLL DIRECTION | CORRECTED QUARRY POSITION | |
|---|---|---|
| | HOR. | VER. |
| LEFT | S−ΔS | T |
| RIGHT | S+ΔS | T |
| UP | S | T−ΔT |
| DOWN | S | T−ΔT |

METHOD AND SYSTEM FOR DISPLAYING IMAGE DATA

This application is a continuation, of application Ser. No. 509,395, filed June 30, 1983 now abandoned.

BACKGROUND OF THE INVENTION

1. FIELD OF THE INVENTION

The present invention relates to a display system for a multi-window display, and more particularly to a display method and system which is suitable for interactive document processing and/or image processing.

2. DESCRIPTION OF THE PRIOR ART

Recently, a system which permits an operator to compose and revise a document interactively with a computer, such as a word processor, has been widely used. In such a system, it is desirable from a standpoint of easiness of document processing to display a full page of document information to be processed. However, since a full-page display is expensive, it is usual except for a special case to display only a portion of the document and add a scroll function to select a displaying area. When a complex document containing mixture of Kanji characters and image data is to be processed, the partial displaying system is used due to a limitation imposed by the resolution of the display. In order to display all of the information of the document on screen, a macro data which is an abbreviated version of the original document information, such as a reduced image of the document or a layout chart of the document by a line diagram is needed. In order to display detailed information of the document (a portion of the document) and the whole information (macro data), the display contents on the screen are switched on a time axis or the detailed information and the whole information are separately displayed on a plurality of displays. In the former method, only one of the detailed information and the whole information is displayed at any time point and hence the comparison of the information is difficult. In the latter method, the apparatus is expensive.

When the sentence or text information such as character data combined with image data is processed the following problems are encountered.

(1) Response to text processing such as insertion, deletion and revision of characters is low.

(2) For printed characters inputted from a facsimile, it is difficult to distinguish the image data from the character data to be processed because they are mixedly displayed on the same screen.

SUMMARY OF THE INVENTION

It is an object of the present invention to provide a display method and system which allow efficient and economic interactive processing of a complex document presenting information having a mixture of Kanji characters and image data.

In accordance with a basic concept of the present invention, one display is virtually regarded as a plurality of displays and a whole information of the document information or a reduced image thereof or a symbolic layout chart thereof (hereinafter collectively referred to as whole information) and a partial information are displayed in parallel so that efficient and economic document processing is attained. More particularly;

(a) a display screen is divided into a plurality of displaying areas (called windows), (b) whole information (macro data) of the document to be processed is displayed in one window and detailed information of a portion of the document is displayed in another window (the former being called a whole-view window and the latter being called a partial-view window), and (c) a mark such as a rectangular frame is displayed in the whole-view window at a position corresponding to that portion of the original document which is being displayed in the partial-view window as the detailed information in order to indicate the correspondence.

In accordance with the present system, the portion of the original document which is to be partially displayed can be selected and moved and the size of the window and the displaying position on the display screen can be specified by operating a keyboard, a light pen and/or a touch panel.

In accordance with the present invention, the display contents of the partial-view window and the whole-view window are always displayed correspondingly. For example, when the document processing such as insertion, deletion or revision of a character is effected on the partial-view window, the contents of the partial-view window as well as the whole-view window are simultaneously updated. The same is true when a document layout is revised on the whole-view window.

BRIEF DESCRIPTION OF THE DRAWINGS

FIG. 4 shows a screen format of a display in FIGS. 1 and 2, FIG. 5 illustrate a quarry area of a partial image in FIGS. 1 and 2, FIG. 6 illustrates a retrieve table in FIGS. 1 and 2, FIG. 15 illustrates a window defining table in FIGS. 13 and 14, FIG. 16 shows a screen format of a display in FIGS. 13 and 14, FIG. 17 illustrates a quary area of a document in FIGS. 13 and 14, FIG. 18 illustrates a retrieve table in FIGS. 13 and 14, FIG. 19 shows commanqs in FIGS. 13 and 14, FIGS. 20, 21 and 23 show processing flows of the commands in FIG. 19.

DESCRIPTION OF THE PREFERRED EMBODIMENTS

Figure 1:
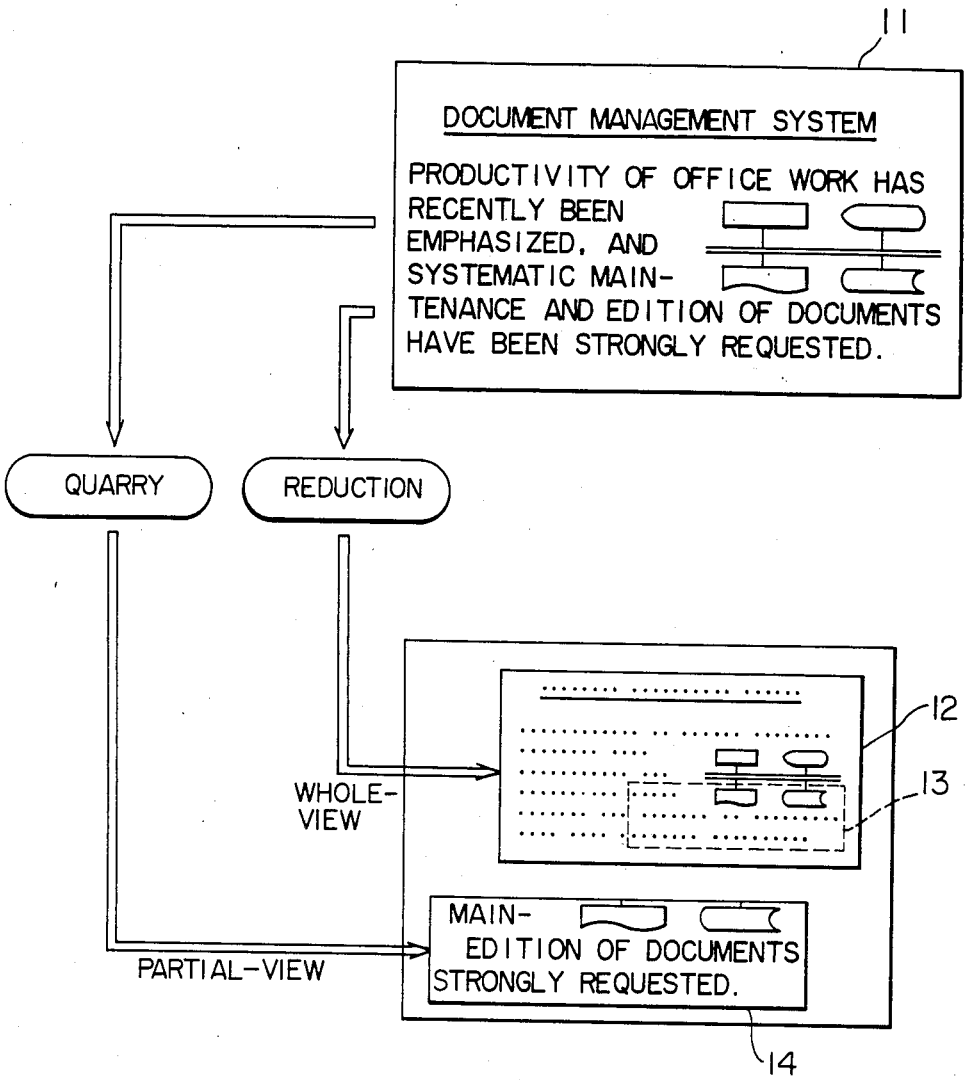
FIG. 1 shows a conceptual view of the present invention.

FIG. 1 shows a conceptual view of the present invention. Numeral 11 denotes document information to be processed. It is reduced and displayed in a whole-view window 12 on a display. Detailed information of a portion of the document information 11 is quarried and displayed in a partial-view window 14. In order to indicate that portion of the original document which is displayed in the partial-view window 14, a rectangular block 13 is displayed at the corresponding position in the whole-view window 12. In FIG. 1, a reduced image of the original document is displayed in the whole-view window. Alternatively, a symbolically represented layout chart such as a line diagram may be displayed.

Figures 2, 3:
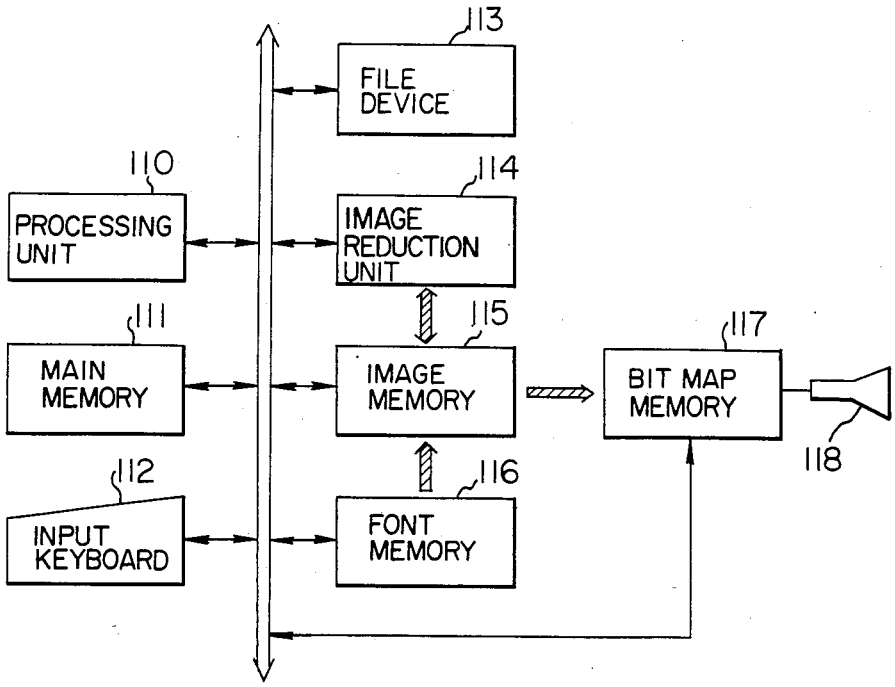
FIG. 2 shows a hardware configuration of one embodiment of the present invention.
FIG. 3 illustrates an window defining table in the embodiment of FIG. 2.

One embodiment of the present invention is shown in FIG. 2. Numeral 110 denotes a processing unit such as a microprocessor, numeral 111 denotes a main memory for storing programs and tables, numeral 112 denotes an input keyboard, numeral 113 denotes a file device for storing document information, numeral 114 denotes an image reduction unit, numeral 115 denotes an image memory for editing the document information, numeral 116 denotes a font memory for storing the character font patterns, numeral 118 denotes a display and numeral 117 denotes a bit map memory for the display 118.

The functions of the respective units of FIG. 2 are as follows. When the title of the document information to be displayed on the display 118 is designated by the input keyboard 112, the corresponding document information is retrieved from the file device 113. The document information usually comprises characters and image data. For the characters, the corresponding font patterns are read out from the font memory 116 and written into the image memory 115. For the image data, the data read out from the file device 113 is written into the image memory 115. In this manner, the document information is edited to a set of image data on the image memory 115 by the character and image data. The image memory 115 comprises two areas A and B. The edition is done in the area A of the image memory 115. After the edition, the image data on the area A is reduced by the image reduction unit 114 and the reduced image data is stored in the area B of the image memory 115. Thus, the image memory 115 contains the original image of the document and the reduced image in the areas A and B, respectively.

The bit map memory 117 stores the display data of the respective picture cells of the display 118. The image data in the image memory 115 is transferred to the bit map memory 117. The image memory 115 contains the reduced image of the document and the original image. The data of the reduced image is transferred to that area of the bit map memory 117 which corresponds to the whole-view window. For the original image in the image memory 115, a partial image is quarried and it is transferred to that area of the bit map memory 117 which corresponds to the partial-view window. In order to indicate that portion of the original image which is quarried as the partial image, a rectangular block is overwritten on the reduced image on the whole displaying window of the bit map memory 117. Since the contents of the bit map memory 117 are displayed on the display 118, a multi-window image as shown in FIG. 1 is displayed.

In order to define an screen format of the display 118, an window defining table as shown in FIG. 3 is stored in the main memory 111. The window defining table defines positions and sizes of the whole-view window and the partial-view window on the display screen, and for the partial-view window, further defines a quarry position on the original image on the image memory 115. The size of the quarry from the original image is equal to the size of the partial-view window. FIGS. 4 and 5 illustrate parameters to be set in the window defining table. As shown in FIG. 4, the position of the whole-view window 151 and the partial-view window 152 are represented by coordinates having an origin point at a left top corner of the screen 150. As shown in FIG. 5, the position of the quarry from the original image 160 on the image memory 115 is represented by coordinates having an origin point at a left top corner of the original image, and the size of the quarry area 161 is equal to the size of the partial-view window.

Figure 7:
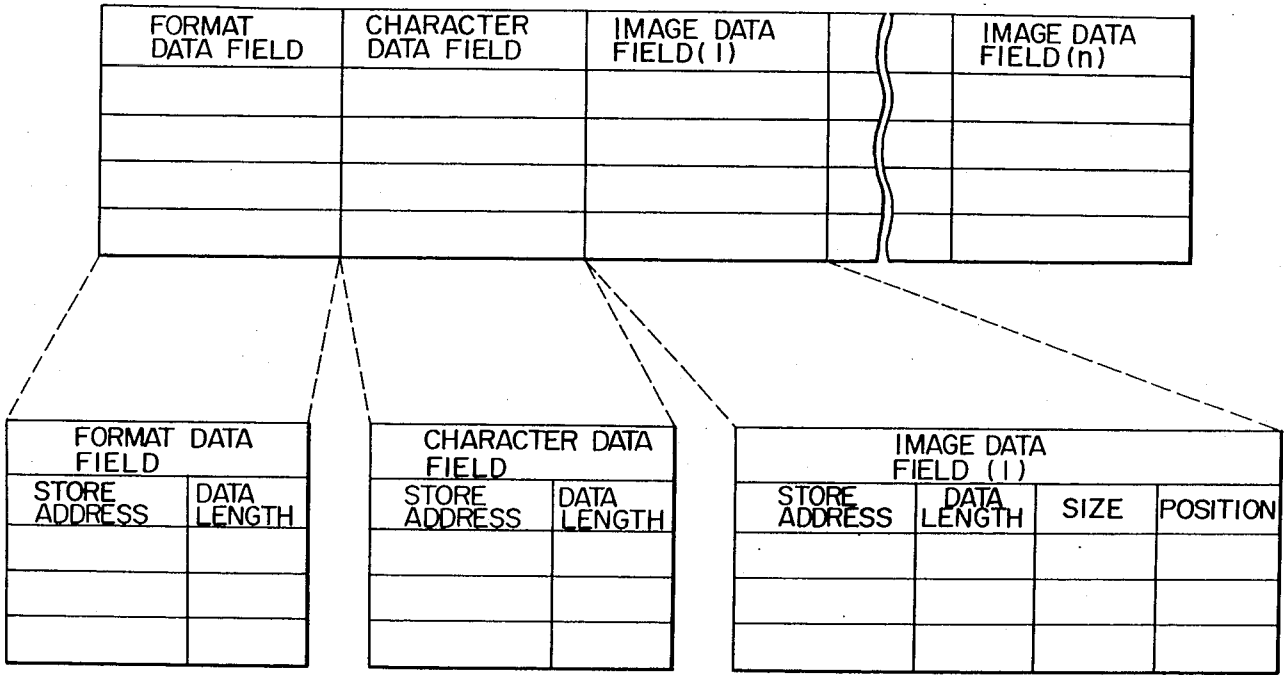
FIG. 7 illustrates a document file in FIG. 1 and 2.

The main memory 111 also stores a retrieve table shown in FIG. 6. The retrieve table shows the correspondence between the title of the document, and the store address and the data length, for the document information stored in the file device 113. The document information stored in the file device 113 comprises format data, character data and image data as shown in FIG. 7. The format data defines a format of the document such as the character pitch (row and column spacings) and top, bottom, left and right margins. The character data for composing the document is stored in the file device 113 in a form of a data string encoded to character codes. The image data is represented by attributes such as size, data length and position on the document, and intensity values of the respective picture cells.

Figures 8, 9:
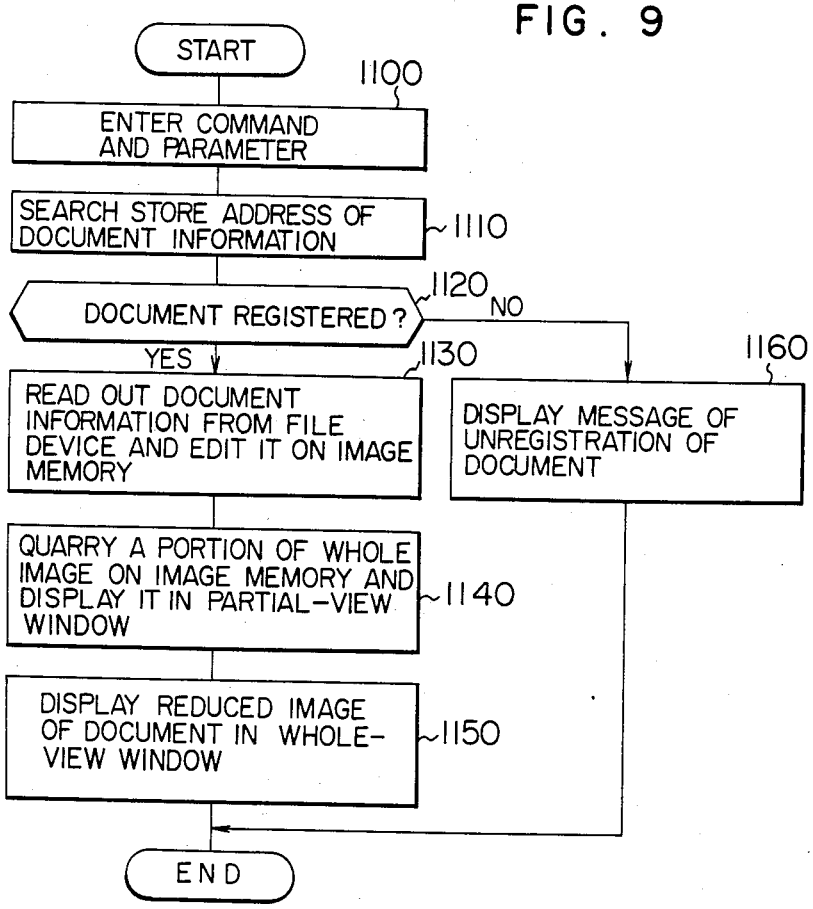
FIG. 8 shows commands in FIGS. 1 and 2, FIGS. 9–12 show processing flows for the commands of FIG. 8.

The present invention is applicable to interactive document processing. Examples of commands used therefor are illustrated in FIG. 8. By inputting the command together with necessary parameters from the input keyboard 112, it is decoded and executed by a program in the processing unit 110. The functions of the respective commands are explained below.

(a) Document retrieve command (FIND)

It commands to read out specified document information from the file device 113 and display it on the display 118. The whole image of the document is displayed in the whole-view window at a reduced scale, and a portion of the document is quarried and displayed in the partial-view window, the processing flow being shown in FIG. 9.

(1) 1100: Enter the command FIND and title of document by the input keyboard 112.

(2) 1110: Determine a store address and a data length of the document information in the file device 113 by looking up the retrieval table (FIG. 6) on the main memory 111.

(3) 1120: Go to a step 1130 if the title of the document is registered in the retrieval table, also go to a step 1160.

(4) 1130: Read out the format data, character data and image data of the document from the file device 113 and edit them on the image memory 115 through the main memory 111. For the character data, read out a font pattern from the font memory 116 and write it into the image memory 115 in a predetermined format. Write the image data read out from the file device 113 into the image memory 115.

Those edit operations are carried out by using the area A of the image memory 115, after the edition, and the image data on the area A is reduced by the reduction processing unit 114 and the reduced image data is written into the area B of the image memory 115.

(5) 1140: Quarry a partial image from the original image on the area A of the image memory 115 and transfer it to an area of the bit map memory 117 which corresponds to the partial-view window. The quarry position of the partial image is determined by a setting of the window defining table of FIG. 3. The size of the image to be quarried and the destination address on the bit map memory 117 are also defined by the window defining table of FIG. 3.

(6) 1150: Transfer the reduced image stored in the area B of the image memory 115 to an area of the bit map memory 117 corresponding to the whole-view window. Display a rectangular block in superposition on the data in the whole-view window in order to indicate the quarry position on the original image.

(7) 1160: Send to the display 118 a message stating that the document information designated by the input keyboard 112 is not found in the file device 113.

(b) Scroll command (SCROLL)

Figure 10:
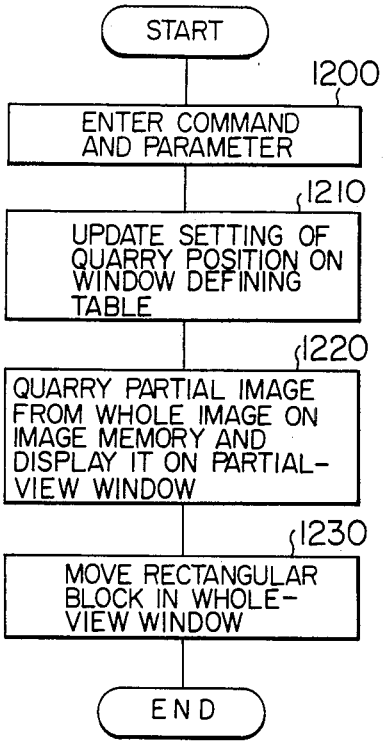

It commands to move a quarry position on the whole image of the document to change the display content of the partial-view window. The processing flow of the command SCROLL is shown in FIG. 10.

(1) 1200: Enter the command SCROLL and a new quarry position of a partial image by the input keyboard 112.

(2) 1210: Set an updated value of the quarry position in the window defining table (FIG. 3).

(3) 1220: Quarry the partial image from the original image on the area A of the image memory 115 and transfer it to an area of the bit map memory 117 corresponding to the partial-view window. The quarry position of the partial image is determined by the value set in the step 1210.

(4) 1230: Move a rectangular block on the whole-view window in accordance with the change of the quarry position of the partial image.

(c) Window change command (SCOPE)

Figure 11:
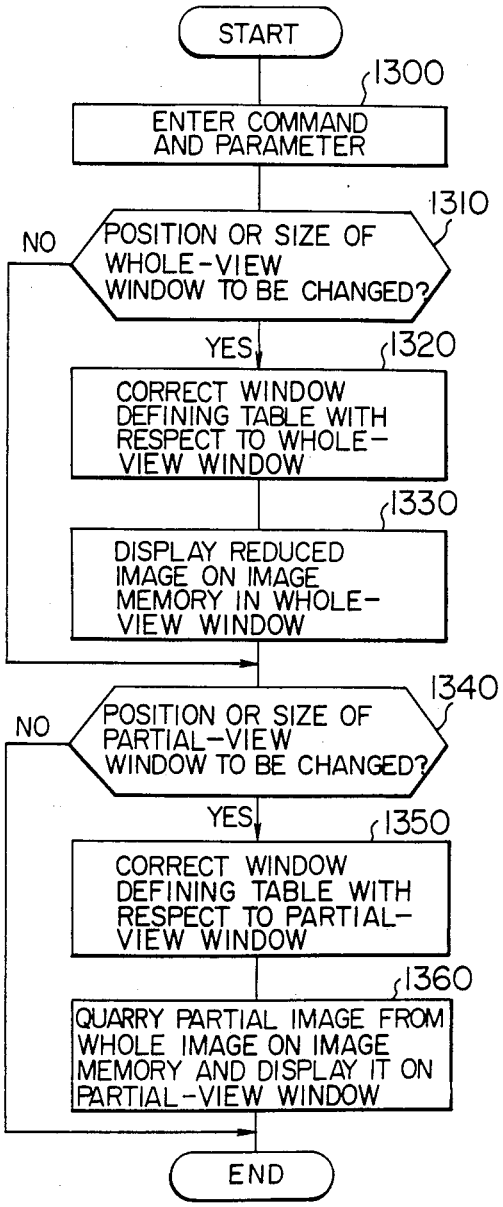

It commands to change positions or sizes of the whole-view window and the partial-view window on the display screen. A processing flow is shown in FIG. 11.

(1) 1300: Enter the command SCOPE and an updated position of the corresponding window on the display screen or an updated size of the window by the input keyboard 112.

(2) 1310: Go to a step 1320 if the position or the size of the whole displaying window on the display screen is to be changed, else go to a step 1340.

(3) 1320: Write the updated position or size of the whole-view window on the display screen into the window defining table.

(4) 1330: Transfer the reduced image stored in the area B of the image memory 115 to an area of the bit map memory 117 corresponding to the whole-view window.

(5) 1340: Go to a step 1350 if the position or size of the partial-view window on the display screen is to be changed, else end.

(6) 1350: Write the position or size of the partial-view window on the display screen into the window defining table.

(7) 1360: Quarry a partial image from the original image or the area A of the image memory 115 and transfer it to an area of the bit map memory 117 corresponding to the partial-view window.

(d) Character insertion command (INSERT) and character delete command (DELETE)

Figure 12:
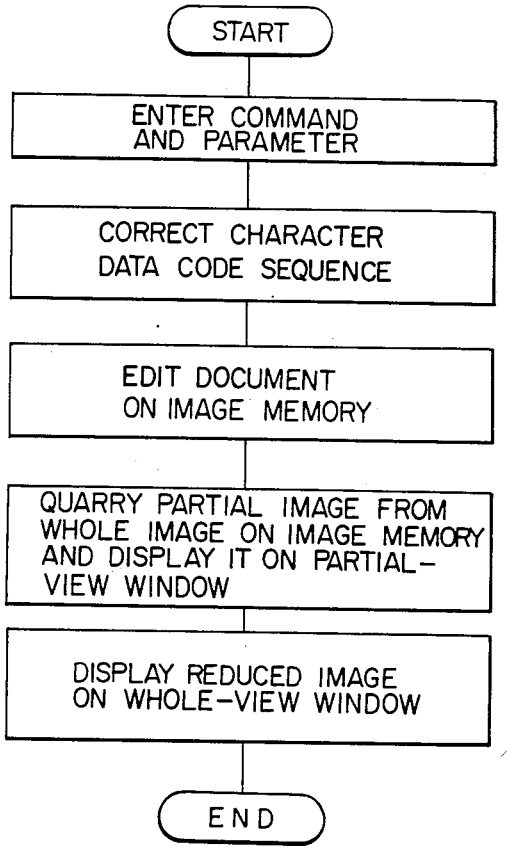

They command to insert a character in the document and delete a character from the document. The processing flow is shown in FIG. 12.

(1) 1400: Move a cursor to a position of insertion or deletion of a character on the partial-view window and enter the command INSERT or DELETE by the input keyboard 112. For the command INSERT, enter a character to be inserted by the input keyboard 112.

(2) 1410: Read a cursor position on the display screen to determine a correction position on the document. Correct the character data (character code sequence) in accordance with the specification of the insertion or deletion.

(3) 1420: Compose the whole image of the document on the area A of the image memory 115 using the corrected character data. Reduce the whole image by the reduction processing unit 114 and write the reduced image data into the area B of the image memory 115.

(4) 1430: Quarry a partial image from the original image (whole image) or the area A of the image memory 115 and transfer it to an area of the bit map memory 117 corresponding to the partial-view window.

(5) 1440: Transfer the reduced image stored in the memory B of the image memory 115 to an area of the bit map memory 117 corresponding to the whole-view window. Display a rectangular block in superposition on the data of the whole-view window to indicate the quarry position on the original image.

While the present embodiment uses two windows, any number of windows may be used on one display screen. While the reduced image of the document information is displayed on the whole-view window in the present embodiment, a symbolically represented layout chart such as a line diagram may be displayed alternatively.

The position and/or the size of the window on the display screen may be changed by updating the window defining table using the keyboard, a light pen or a touch panel.

A second embodiment of the present invention is now explained in detail.

In the second embodiment, a display having a bit map memory, a character memory and a pattern memory as a refresh memory is used. The bit map memory stores display data for the respective picture cells on the display screen. The pattern memory stores font patterns of characters. Each character font pattern may have a size of 28 dots along the horizontal by 30 dots along the vertical and the data for several thousands of characters are stored in the pattern memory. The display screen is divided into M rows by N columns cells, and the display data for the respective cells are in the two-dimension array character memory. The content at an i-th row and a j-th column ($1 \leqq i \leqq M$, $1 \leqq j \leqq N$) of the character memory is represented by $a_{ij}$, and the character font stored at the address $a_{ij}$ of the pattern memory is displayed at the i-th row and the j-th column on the display screen. The display having the bit map memory, the character memory and the pattern memory has already been put into practice and a principle of operation thereof is known in the art. Therefore, it is not explained here.

The present invention relates to a display system of the document information comprising characters and image data. It is assumed that the display herein used has the bit map memory, the character memory and the pattern memory. A principle of the second embodiment of the present invention is now explained.

(1) The display screen is divided into a plurality of areas (windows), and the content of the bit map memory is displayed in one of the windows (called an image window) and the content of the character memory is displayed in another window (called a text window).

(2) The whole information (characters and image data) of the document to be processed is displayed in the image window and a partial area (containing only characters) of the document is quarried and display in the text window.

(3) The content displayed in the text window is the partial area quarried from the original document. An identification mark for the quarry position is displayed in the image window in superposition on the document image. The quarry position can be changed (or scrolled) by the input keyboard and the quarry position identifying mark is moved in the image window as the quarry position is changed.

Figure 13:
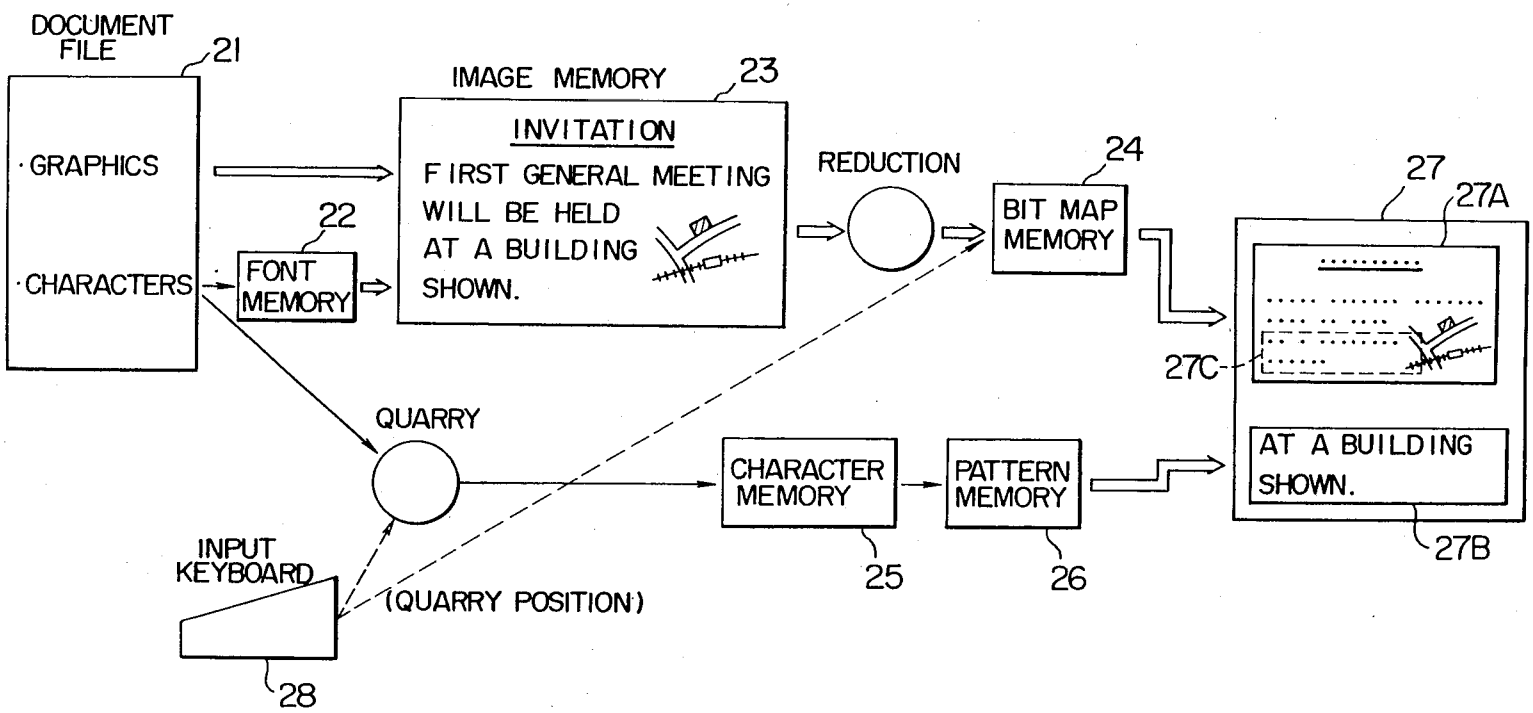
FIG. 13 shows a conceptual view of a second embodiment of the present invention.

FIG. 13 illustrates a principle of the second embodiment. Numeral 21 denotes a document file for storing the document information comprising characters and image data, numeral 22 denotes a character font memory, numeral 23 denotes an image memory, numeral 24 denotes a bit map memory, numeral 25 denotes a character memory, numeral 26 denotes a pattern memory, numeral 27 denotes a display screen, numeral 27A denotes an image window on the image screen, numeral 27B denotes a text window, numeral 27C denotes a quarry position mark and numeral 28 denotes an input keyboard. The document information to be processed is read out from the document file 21 to compose a whole image of the document on the image memory 23. The character data is developed into character font patterns using the font memory 22, which are then written into the image memory 23. The resulting whole image is reduced at an appropriate ratio and the reduced image is written into the bit map memory 24. The character data in a specified partial area on the document is quarried and written into the character memory 25. An identification mark for the quarry position is overwritten into the bit map memory 24 in superposition to the document image. The content of the bit map memory 24 is displayed in the image window 27A and the content of the character memory 25 is displayed in the text window 27B. The data displayed in the text window is the character data quarried from the partial area specified by the quarry mark C in the image window 27A.

Figure 14:
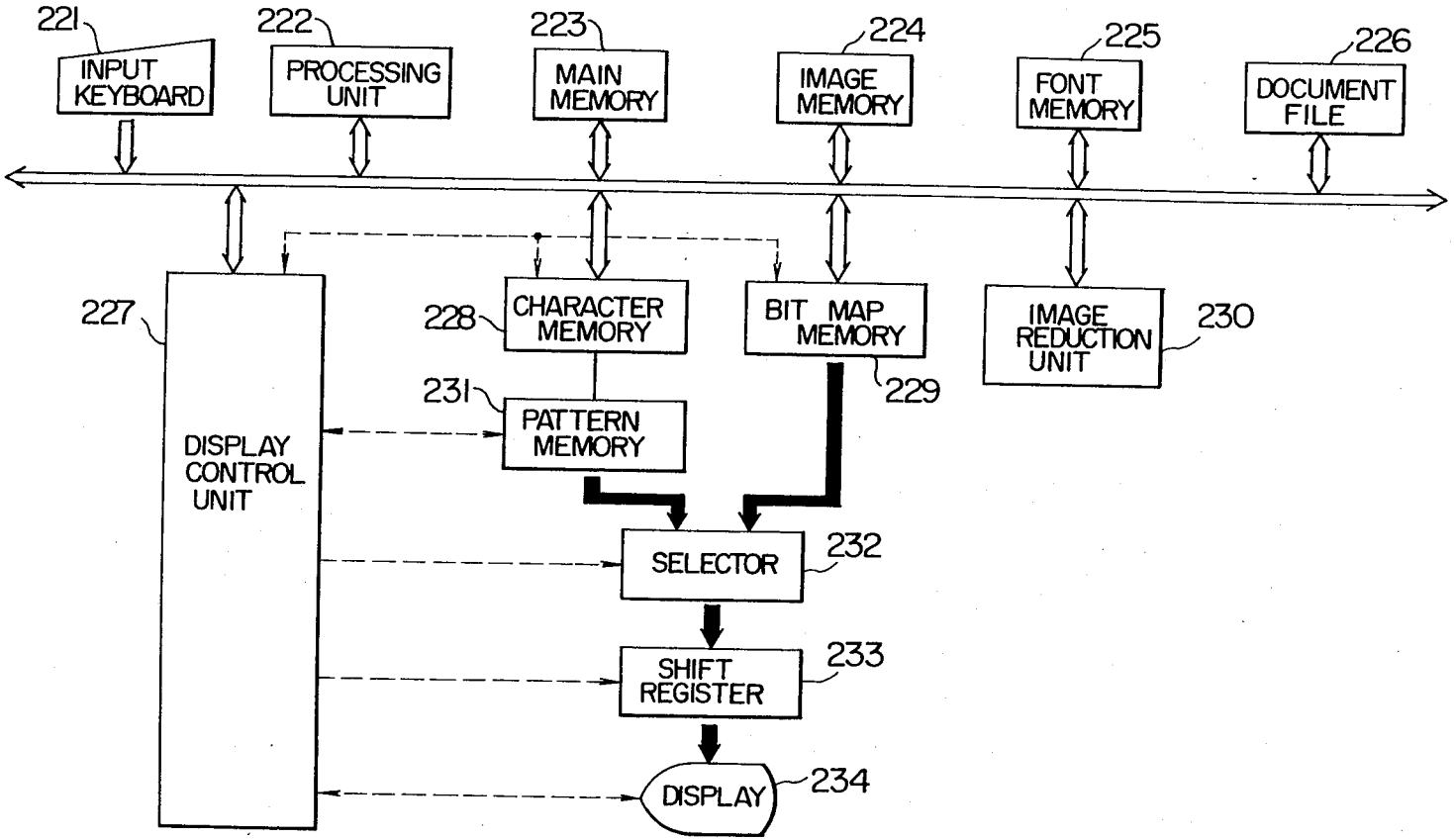
FIG. 14 shows a hardware configuration of the second embodiment of the present invention.

The second embodiment of the present invention is shown in FIG. 14. Numeral 221 denotes an input keyboard, numeral 222 denotes a processing unit such as a microprocessor, numeral 223 a main memory for storing a program, a table and temporarily stored data, numeral 224 denotes an image memory for editting the document information to compose a document image, numeral 225 denotes a font memory for storing character font patterns, numeral 226 a document file for storing document information such as characters and image data, numeral 227 denotes a display control unit, numeral 228 denotes a character memory, numeral 229 denotes a bit map memory, numeral 230 denotes an image reduction unit, numeral 231 denotes a pattern memory, numeral 232 denotes a selector, numeral 233 denotes a shift register and numeral 234 denotes a display.

The functions of the units shown in FIG. 14 are as follows. When a title of document information to be displayed on the display 234 is specified by the input keyboard 221, the corresponding document information is retrieved from the document file 226. The document information comprises characters and image data. For the characters, corresponding font patterns are read from the font memory 225 and written into the image memory 224. For the image data, the data read from the document file 226 is written into the image memory 224. The characters and the image data are edited to compose a whole image of the document in the image memory 224. The image is reduced at an appropriate ratio by the image reduction unit 23 and the reduced image is written into the image memory 224. Once the reduced image is produced, the original image stored in the image memory is no longer necessary and only the reduced image is stored in the image memory 224.

In order to define a screen format of the display 234, the main memory 223 has a window defining table shown in FIG. 15. The window defining table defines positions and sizes of the window on the display screen and defines a quarry position on the document. Any number of windows can be set although two windows are shown in FIG. 15 for the sake of convenience. The size of the quarry area corresponds to the size of the text window. Parameters to be set in the window defining table are shown in FIGS. 16 and 17. As shown in FIG. 16, the positions of the image window 251 and the text window 252 are represented by coordinates having an origin point at a top left corner of the display screen 250. As shown in FIG. 17, the quarry position is represented by coordinates having an origin point at a top left corner of the document image 260 and the size of the quarry area 261 is equal to the size of the text window.

The character data in the quarry area defined by the window defining table of FIG. 15 is quarried and the data is written into the character memory 228. The data in the character memory 228 is developed to character font patterns by referring to the pattern memory 231 and the character font patterns are displayed on the text window of the display 234. On the other hand, a quarry position mark is written into the bit map memory in superposition to the reduced image and the content of the bit map memory 229 is displayed on the image window of the display 234.

The data is read from the bit map memory 229 and the pattern memory 231 in synchronism with the raster scan of the screen to refresh the display 234. The selector 232 has a function to select one of the output data from the bit map memory 229 and the output data from the pattern memory 231. The output data from the selector 232 is converted to serial data by the shift register 233. The selector 232 is controlled by the display control unit 227 in accordance with the position and the size of the window set by the window defining table. The display control unit 227 generates various signals to refresh the display 234. The function of the display control unit 227 is known in the art and it is not explained here.

The main memory 223 also contains a retrieval table shown in FIG. 18. The retrieval table indicates a correspondence between the title of the document, and a store address and a data length for the document information stored in the document file 226.

The present embodiment can be applied to interactive document processing. Examples of commands therefor are shown in FIG. 19. A command and necessary data are inputted from the input keyboard 221 and they are decoded and executed by the program of the processing unit 222. The processing contents of the respective commands are explained below.

(a) Document retrieve command (FIND)

Figure 20:
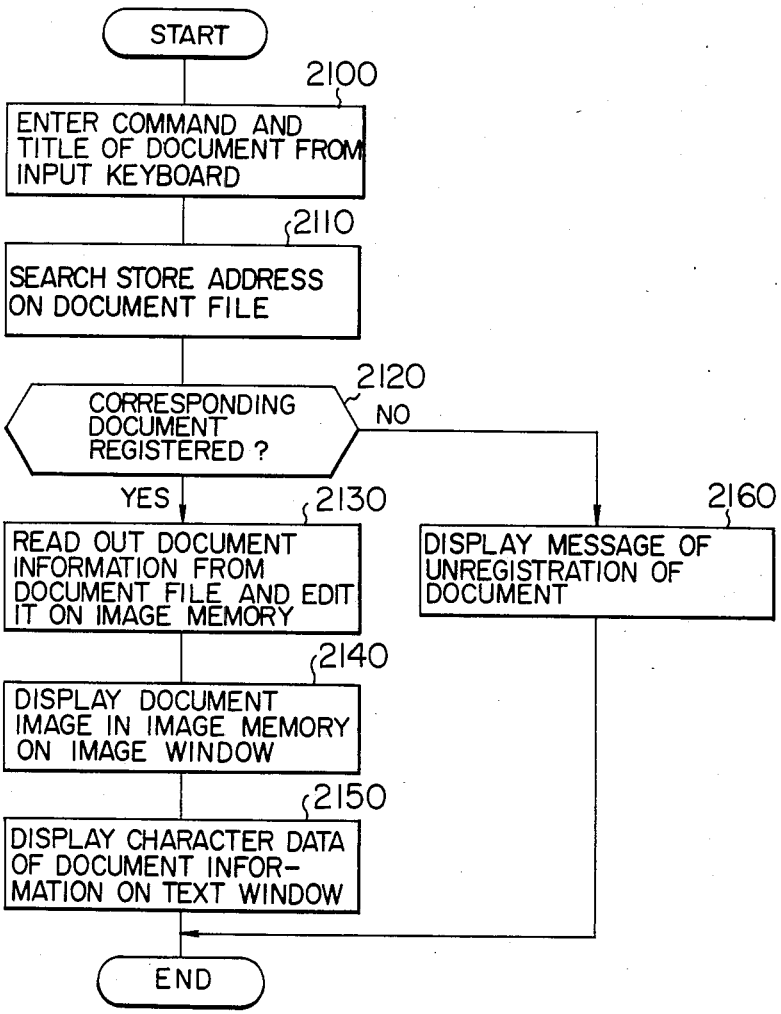

It commands to read out specified document information from the document file 226 and display it on the display 234. A processing flow of the command FIND is shown in FIG. 20.

(1) 2100: Enter the command FIND and the title of the document to be retrieved by the input keyboard 221.

(2) 2110: Determine the store address and the data length of the corresponding document information in the document file 226 by referring to the retrieval table (FIG. 18) in the main memory.

(3) 2120: Go to a step 2130 if the title of the document is found in the retrieval table, else go to a step 2160.

(4) 2130: Read out the character data and image data of the document from the document file 226 and edit them in the image memory 224 through the main memory 223. For the character data, develop it to character font patterns using the font memory 225 and write the font patterns into the image memory 224. Reduce the composed document image by means of the image reduction unit 230 and write the reduced image into the image memory 224. Write an identification mark for identifying the quarry position into the image memory in superposition to the document image by referring the window defining table.

(5) 2140: Transfer the document information and the quarry position mark on the image memory 224 to the bit map memory 229. The data store position on the bit map memory 229 is determined by the position and the size of the image window (see FIGS. 15 and 16) defined by the window defining table.

(6) 2150: Write the character data of the document information in the quarry area defined by the window defining table (FIG. 15) into the character memory 228 and display it in the text window of the display 234.

(7) 2160: Display on the display 234 a message stating that the document information specified by the input keyboard 221 is not stored in the document file 226.

(b) Scroll command (SCROLL)

Figure 21:
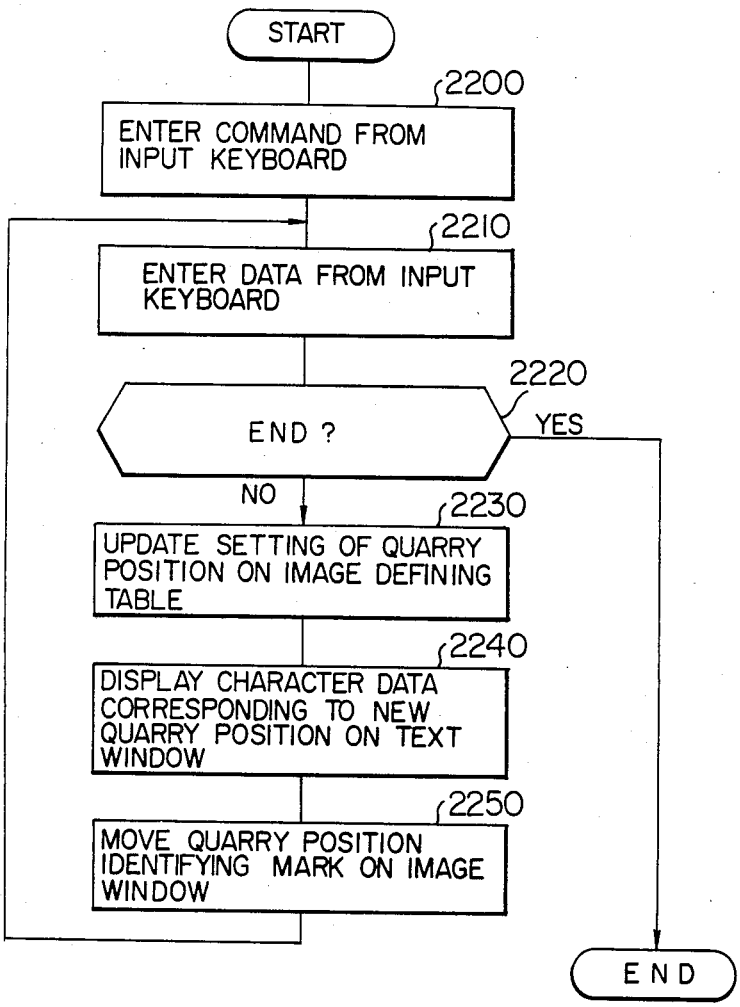

It commands to move the quarry area on the document to change the display content on the display 234. A processing flow of the command SCROLL is shown in FIG. 21.

(1) 2200: Enter the command SCROLL by the input keyboard 221.

(2) 2210: Enter a parameter of the command by the input keyboard 221. The parameter indicates the direction (up, down, right, left) of the scrolling and an end of the scrolling.

(3) 2220: Determine if the read command parameter indicates the end of scrolling, and if yes, end the processing, else go to a step 2230.

Figures 22, 23:
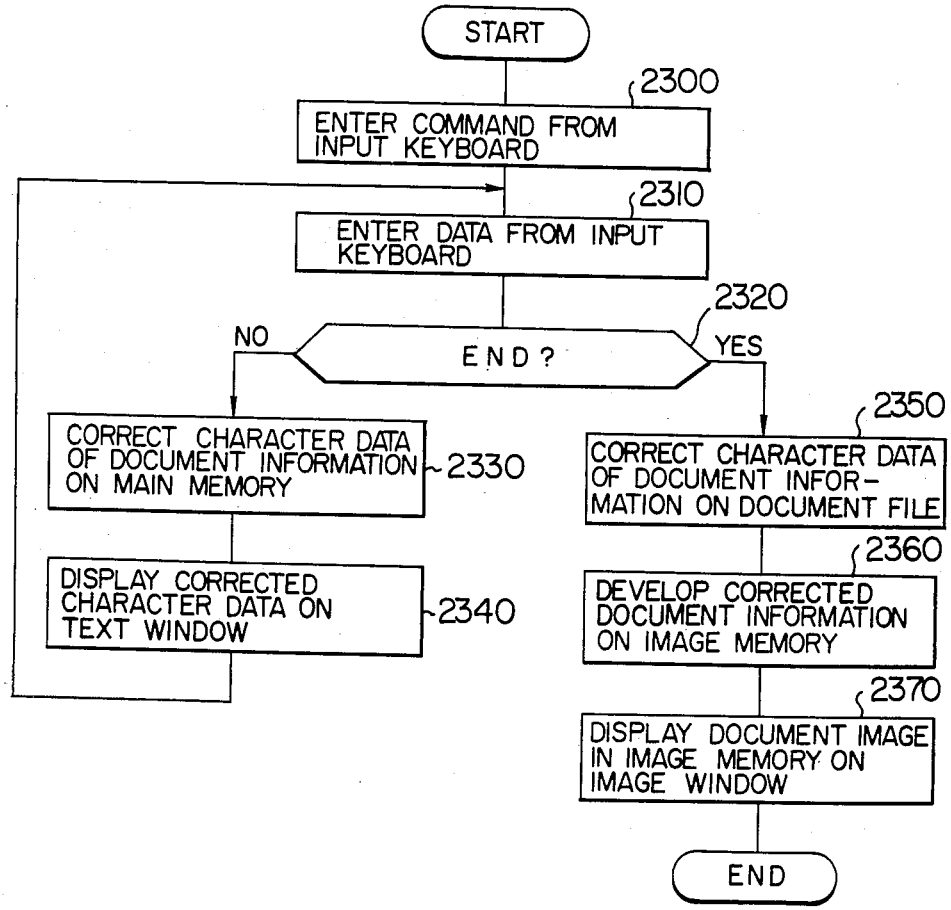
FIG. 22 illustrates correction of a quarry portion for a scroll command.

(4) 2230: Correct the setting of the quarry position on the window defining table in accordance with the indication of the direction of scroll. The quarry position in the window defining table is updated as shown in FIG. 22 where symbols S and T are settings before correction and $\Delta S$ and $\Delta T$ are positive constants.

(5) 2240: Transfer the character data corresponding to the corrected quarry area to the character memory 228 and display them in the text window on the display 234.

(6) 2250: Move the quarry position mark in the bit map memory 229 to indicate the new quarry position and display it in the image window on the display 234.

(c) Character insert/delete commands (INSERT and DELETE)

The command INSERT commands to insert new data in a document, and the command DELETE commands to delete character data from the document. A processing flow of those commands is shown in FIG. 23.

(1) 2300: Enter the command INSERT or DELETE by the input keyboard 221.

(2) 2310: Enter a parameter of the command by the input keyboard 221. The parameter indicates:

① character data to be inserted and an insertion position,

② a position of a character to be deleted on the document, or

③ end of processing.

(3) 2320: Go to a step 2350 if the parameter entered by the input keyboard 221 indicates the end of processing, else go to a step 2330.

(4) 2330: Correct (insert or delete) character data of the corresponding document information in the main memory 223.

(5) 2340: Quarry the corrected character data of the document which are in a quarry area specified by the window defining table and write it into the character memory 228 and display it in the text window on the display 234.

(6) 2350: Write the corrected character data in the main memory 223 into the document file 226.

(7) 2360: Develop the corrected character data in the main memory 223 into the image memory 224 to compose a new document image. Reduce the document image by means of the image reduction unit 230 and write the reduced image into the image memory 224.

(8) 2370: Transfer the document image and the quarry position mark on the image memory 224 to the bit map memory 229 and display them in the image window on the display 234.

While the display screen has two windows in the present embodiment, any number of windows may be provided, and the window defining table may be updated by the keyboard or other means (such as light pen or touch panel) to change the position and size of the window on the display screen, as is done in the first embodiment.

According to the present invention, a plurality of display areas (windows) are provided on the display screen so that the macro or whole display and the micro or partial display of the document are simultaneously displayed, and the area of the partial display is indicated on the whole-view window. Accordingly, the present invention provides the following advantages:

(1) The correspondence of the whole information and the partial information of the document is readily known.

(2) The layout work of the whole document is provided on the whole-view window and the insertion and the deletion of the character are performed on the partial-view window. Thus, the windows are selectively used depending on the resolution required, and the position and the size of the window can be changed. Therefore, a high operability is attained.

(3) To compare with a system which uses a plurality of displays to separately display the whole information and the partial information of the document, the present system is of low cost because it uses only one display.

(4) To compare with a full-page display system in which one page of micro whole data of the document displayed on one display screen, the present system is of low cost because the resolution required for the display of the present system may be low.

Further, the second embodiment of the present invention which processes and displays the text data provides the following advantages.

(1) The correspondence between the whole information and the partial information of the document is readily known. By checking the layout of the whole document on the image window and inserting and deleting the character on the text window, the windows are selectively used depending on the resolution required and the operability is improved.

(2) The document information usually comprises the character data and the image data. It has been difficult in the prior art system to discriminate on the display image data such as printed characters inputted from a facsimile and character data to be text-processed. In accordance with the present embodiment, the image data and the character data can be readily discriminated because only the character data is displayed on the text window.

(3) The updating of the display due to the text processing such as insertion and deletion of the character is performed by updating the code data in the character memory. Therefore, the response is faster than a system in which the data is developed to the image data by software one character at a time. (However, the display content in the image window is not updated until the end of processing such as insertion or deletion is indicated.)

(4) To compare with the system, which uses a plurality of displays to separately display the whole information and the partial information of the document, the present system is of low cost because it uses only one display.

(5) To compare with the full-page display system, the present system is of low cost because the resolution required for the display of the present system may be low.

I claim:

1. A multi-window image displaying method comprising:

a first step of writing in an image memory image data forming an original whole image representative of the whole of a page of a document including both character data and image data, said characters being stored in said image memory as data in the form of character font patterns;

a second step of reducing the scale of said original whole image by processing the image data from said image memory in accordance with a selected reduction factor to provide data forming a reduced whole image;

a third step of producing image data forming a partial image representative of a partial area of said document page including only character data concerning the character including in said partial area;

a fourth step of defining the positional correspondence between sadi partial image and said whole image; and a fifth step of simultaneously displaying said reduced whole image in a first window of a display screen and said partial image including only character data in a second window of said display screen, said reduced whole image being displayed in said first window together with a mark said reduced whole image at the location to which said partial image being displayed in said second window corresponds in accordance with said defined positional correspondence, said partial image being displayed with a higher resolution than said reduced whole image.

2. A multi-window image displaying method according to claim 1, wherein in said third step said partial image is quarried from the image data forming said orginal whole image written in said image memory in said first step.

3. A multi-window image displaying system comprising:

an image memory for storing an original whole image representative of the whole of a page of document including at least characters, said characters being stored in the form of character font patterns in said image memory;

image reduction means for reducing said original whole image from said image memory in accordance with a selected reduction factor to produce a reduced whole image;

partial image producing means for producing a partial image representative of a partial area of said document page;

a bit map memory for storing said reduced whole image;

means for storing positioned data indicating correspondence of position between said partial image and said whole image;

means for supplying mark data representative of a position of said partial area in said document page to said bit map memory to overwrite in said reduced whole image a mark positional in said reduced whole image at the location therein to which said partial image corresponds as indicated by said storing means; and display means including a display screen, and connected to receive said reduced whole image with said mark and said partial image, for displaying in a first window on said display screen said reduced whole image with said mark and for displaying in a second window on said display screen said partial image with a higher resolution than said reduced whole image.

4. A multi-window image displaying system according to claim 3, wherein said iamge memory has a first area in which said original whole image is stored and a second area in which said reduced whole image produced by said image reduction means is stored, said partial image producing means comprises means for producing said partial image by quarrying said partial image from said original whole image stored in said first area of said image memory, and said bit map memory having a first area which corresponds to said first window of said display screen and to which said reduced whole image stored in said second area of said image memory is transferred and a second area which corresponds to said second window of said display screen and to which said partial iamge quarried from said original whole image is transferred.

5. A multi-window image displaying system according to claim 3, wherein said partial image producing means includes a character memory for storing character data concerning characters included in said partial area of said document page, and said reduced whole image with said mark stored in said bit map memory is transferred to said first window of said display screen wile the contents of said character memory are transferred as said partial image to said second window of said display screen.

6. A multi-window image displaying method comprising:

a first step of writing in an image memory image data forming an original whole image representative of the whole of a page of a document including at least characters, said characters being stored in said image memory as data in the form of character font patterns;

a second step of reducing the scale of said original whole image by processing the image data from said image memory in accordance with a selected reduction factor to provide data forming a reduced whole image;

a third step of storing data representing a postional correspondence between said whole image and a partial image representative of a partial area of said document page in table means which also stores position data defining a position of a first window of a display screen to display said reduced whole image and position data defining a position of a second window of said display screen to display said partial image;

a fourth step of producing image data forming said partial image by extracting a part of said image data in said image memory on the basis of said positional correspondence data in said table means;

a fifth step of simultaneously displaying said reduced whole image together with a mark in said first window of said display screen and said partial image in said second window of said display screen on the basis of position data in said table means, said mark being positioned in said reduced whole image at the location to which said partial image being displayed in said second window corresponds in accordance with said stored positional correspondence data, said partial image being displayed with a higher resolution than said reduced whole image.

7. A multi-window image displaying method according to claim 6, wherein said fourth step includes changing the contents of said second window of said display screen in response to a command inputted by an operator by changing said data respresenting postional correspondence between said whole image and said partial image in said table means.

8. A multi-window image displaying method according to claim 6, wherein said fourth step and fifth step are carried out to change synchronously both the position of said mark displayed in said first window and the contents of said partial image in said second window in the display screen in response to a command inputted by an operator to scroll the contents of said second window.

9. A multi-window image displaying method according to claim 6, wherein said fourth step and fifth step are carried out to chagne synchronously both the size of said mark displayed in said first window and the size of said partial image quarried from said original whole image to be displayed in said second window in response to a command inputted by an operator to change the size of said second window.

* * * * *